US007810179B2

(12) United States Patent
Fujikawa

(10) Patent No.: US 7,810,179 B2
(45) Date of Patent: Oct. 12, 2010

(54) SCALP WASHING DEVICE

(75) Inventor: Susumu Fujikawa, Saitama (JP)

(73) Assignee: Thales Co., Ltd., Tokyo (JP)

( * ) Notice: Subject to any disclaimer, the term of this patent is extended or adjusted under 35 U.S.C. 154(b) by 502 days.

(21) Appl. No.: 11/826,257

(22) Filed: Jul. 13, 2007

(65) Prior Publication Data

US 2008/0244823 A1 Oct. 9, 2008

(30) Foreign Application Priority Data

Apr. 6, 2007 (JP) ..... 2007-100278

(51) Int. Cl.
*A45D 19/02* (2006.01)

(52) U.S. Cl. ..... 4/518; 4/519; 4/515

(58) Field of Classification Search ..... 4/515–523
See application file for complete search history.

(56) References Cited

U.S. PATENT DOCUMENTS 2,914,066 A * 11/1959 Gow ..... 4/517
3,177,868 A * 4/1965 Wallace et al. ..... 4/517
3,343,530 A * 9/1967 Solos et al. ..... 4/518
5,012,534 A * 5/1991 McWhorter ..... 4/519
5,906,012 A * 5/1999 Sakane et al. ..... 4/519

* cited by examiner

*Primary Examiner*—Khoa D Huynh
(74) *Attorney, Agent, or Firm*—Arent Fox LLP

(57) ABSTRACT

In a scalp washing device a droplet preventing plate is provided positioned between a user's scalp and face, a nozzle having a single discharge port which discharges hot water to the scalp side of the droplet preventing plate is disposed, and hot water discharged from the discharge port of the nozzle is dispersed along the droplet preventing plate so as to be supplied to the user's scalp. For this reason, the flow rate of the hot water is reduced during the dispersion along the droplet preventing plate, and at the time when the hot water is separated from the edge of the droplet preventing plate and is supplied to the user's scalp, the hot water is supplied slowly to the entire scalp, and droplets are not generated. Even if a small gap is generated between the droplet preventing plate and the user's face, the droplets do not leak to the user's face, wetting it.

5 Claims, 3 Drawing Sheets

SCALP WASHING DEVICE

BACKGROUND OF THE INVENTION

1. Field of the Invention

The present invention relates to a scalp washing device which washes a user's scalp while the user is in an upward facing position.

2. Description of the Related Art

Conventional scalp washing devices include a sink-shaped catchment container. Also included is a head support portion, which is positioned above the container and is configured so that a user's head is supported in an upward facing position. A plurality of shower nozzles is disposed in the container, and a cover is placed over both a portion of the user's scalp and the shower nozzles so that hot water jetted out from the shower nozzles does not disperse to outside the covered region.

Hot water is jetted out from the shower nozzles into the cover and the user's scalp is showered directly with the jetted hot water so as to be washed.

A support fixture which supports the user's neck is provided on an edge of the container. The user's neck is placed on the support fixture and their scalp is washed while their head is held upward in a cantilevered state. Such scalp washing devices are disclosed, for example, in Japanese Patent Application Laid-Open Nos. 2002-34638 and 2003-33220.

In such conventional scalp washing devices, since a user's scalp is showered directly with hot water jetted out from the shower nozzles so as to be washed, it is necessary that the hot water is jetted from the shower nozzles reasonably swiftly. When the hot water is jetted swiftly, the space covered by the cover and the container is filled with droplets, and some of these droplets may drop onto the user's face, wetting it.

When a droplet preventing plate is attached along a portion of the user's forehead between their scalp and face, the dropping of any droplets onto their face can be prevented. However, the droplet preventing plate and the user's forehead should be sealed together without a gap, and as the shape of the forehead varies from one person to another, a gap is likely to be generated. For this reason, the dropping of droplets onto a user's face cannot be completely prevented. The droplet preventing plate can be pressed against the user's forehead; however, this may cause a feeling of discomfort and even pain.

SUMMARY OF THE INVENTION

The scalp washing device of the present invention is characterized by including: a container which is positioned below a user's head, said head being positioned in an upward facing position; a hot water jetting section which supplies hot water to a user's scalp; a droplet preventing plate which is positioned between the user's scalp and face; and a nozzle having a single discharge port which discharges hot water to the scalp side of the droplet preventing plate wherein the hot water discharged from the discharge port of the nozzle is dispersed along the droplet preventing plate so as to be supplied to the user's scalp.

In the present invention, the nozzle which does not have a shower nozzle but instead has the single discharge port is used. The use of this nozzle makes generation of droplets from the discharged hot water difficult. The discharged hot water flows along the surface of the droplet preventing plate onto the user's scalp. As a result, the hot water disperses along the droplet preventing plate, and thus, droplets are not generated. The flow rate of the hot water is reduced during its dispersion along the droplet preventing plate, and at the point when the hot water is separated from an edge of the droplet preventing plate and is supplied to the user's scalp, the hot water is slowly supplied to the entire scalp, and droplets are not generated. For this reason, even if a small gap is generated between the droplet preventing plate and the user's face, the droplets do not leak onto the user's face and wet them.

Head size will vary from one person to another. Therefore, an adjusting mechanism is provided so as to adjust the position of the droplet preventing plate with respect to the user's head, and a locating section is provided on a portion of the droplet preventing plate to allow it to be located with respect to the user's head. As a result, even when head shape varies, the droplet preventing plate can be located with respect to each individual's head.

In a conventional scalp washing device, since a user's head is supported only by their neck during the washing of their scalp, the person whose scalp is being washed may feel discomfort due to pain at the back of their neck where their neck meets the neck support portion. Therefore, a fixing support section which supports the user's neck is provided on the edge of the container, and a movable supporting section which can adjust the gap between it and the fixing support section, and supports the back of the head, is provided onto the container. As a result, even though the length of different people's necks varies, the back of a person's head can be supported, and any burden on their neck can be reduced.

When the back of the head is supported, the supply of hot water to the back of the head is occasionally inhibited. Therefore, the movable supporting section is formed into a bowl shape so as to be capable of storing hot water, and the back of the head is soaked in the hot water stored in the movable supporting section. As a result, the supply of hot water to the back of the head is ensured.

A cover which covers the nozzle and the droplet preventing plate is provided, and the cover is extended so as to cover at least a part of the user's face, with a predetermined space being secured between the cover and their face. As a result, the person whose scalp is being washed can inhale negative ions generated from the hot water and any aroma from an aromatic component that may be added to the hot water.

DETAILED DESCRIPTION OF A PREFERRED EMBODIMENT

Figure 1:
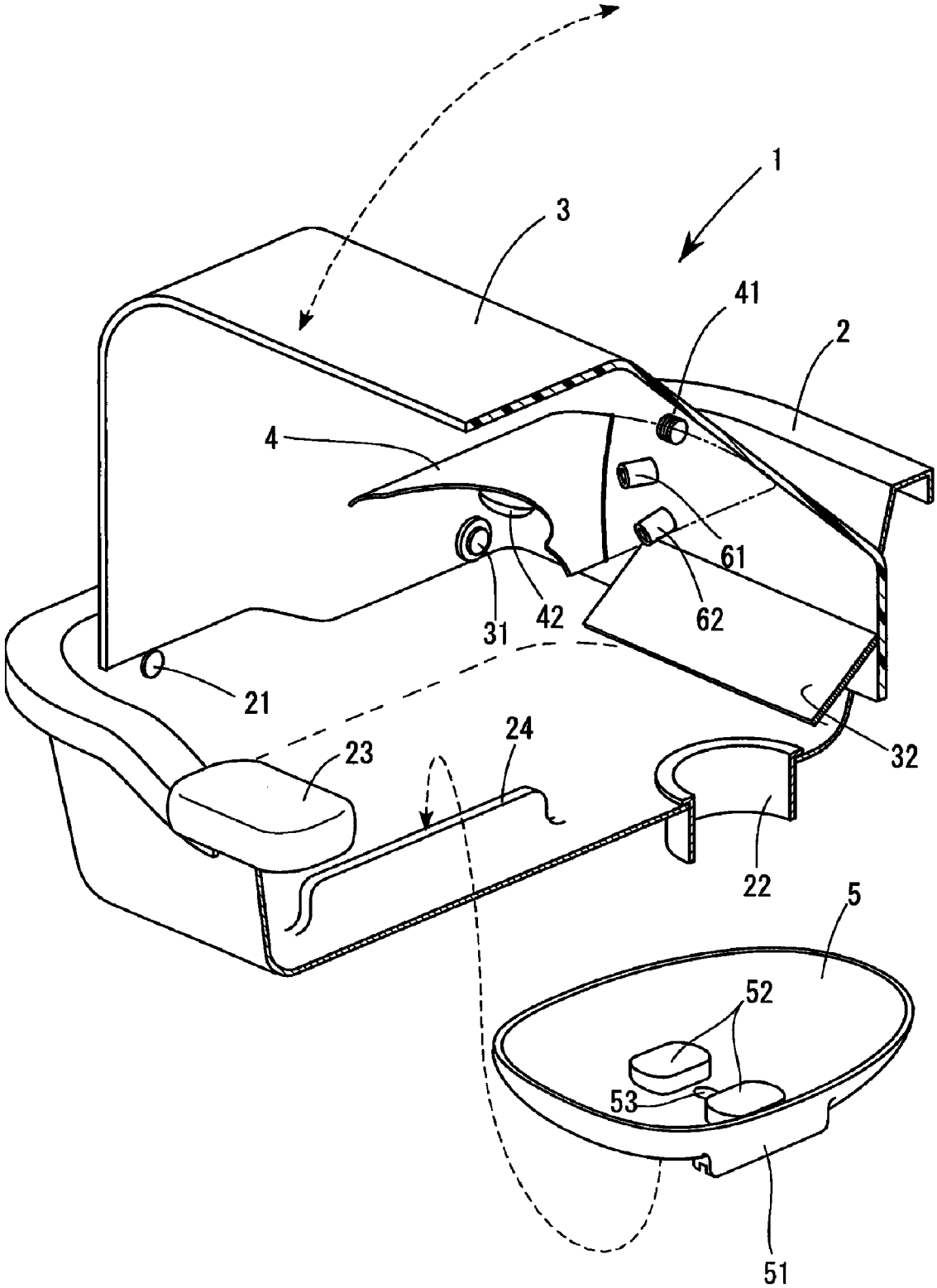
FIG. 1 is a diagram illustrating one configuration of a scalp washing device according to one embodiment of the present invention.

One example of a scalp washing device 1 is described with reference to FIGS. 1 and 2. The scalp washing device 1 has a sink-shaped container 2 which is opened at its upper portion, and a cover 3 is attached to the container 2 so as to be capable of being freely opened and closed. The cover 3 can oscillate on a mounting section 31, and the oscillation to a position where the upper portion of the container 2 is covered is regulated by a stopper 21 formed on the container 2.

A drain outlet 22 having a comparatively large diameter is formed on a bottom portion of the container 2. When hot water is discharged into the container 2, the hot water is drained from the drain outlet 22 to a region outside the scalp washing device 1. A part of one edge of the container 2 is hollowed down, and a support fixture 23 is attached to the hollowed portion. The support fixture 23 is formed of a material such as hard sponge which can be elastically deformed, and supports a user's neck when their scalp is being washed.

A pair of right and left rails 24 is formed on the bottom of the container 2, and a movable supporting section 5 is mounted onto the rails 24 so as to be movable along the rails 24. The movable supporting section 5 is formed into a bowl shape and is opened at its upper portion, and a leg portion 51 which is slidably engaged with the rails 24 is provided on a lower surface of the bottom of the movable supporting section 5. A pair of right and left pads 52 is provided in the movable supporting section 5. When the scalp is being washed, the back of the head is placed on the pads 52, and the entire head is supported by the movable supporting section 5. Since the movable supporting section 5 is movable, the position of the pads 52 can be adjusted according to the shape of a user's head and the length of their neck. A drain outlet 53 having a comparatively small diameter is formed on the movable supporting portion 5. While a user's scalp is being washed, hot water which flows into the movable supporting section 5 overflows from the movable supporting section 5, and after the washing of the scalp ends, the hot water accumulated in the movable supporting section 5 is drained from the drain outlet 53.

A droplet preventing plate 4 is mounted onto an inner surface of the cover 3. The droplet preventing plate 4 is mounted onto the cover 3 via a joint portion 41 and can oscillate up and down on said joint portion 41. The front edge of the droplet preventing plate 4 is cut into a semicircular shape, and a forehead pad 42 is mounted onto the cut portion. When the user's scalp is being washed, the droplet preventing plate 4 is lowered to a position where the forehead pad 42 touches the user's forehead. As a result, the droplet preventing plate 4 is located against the user's head during the washing procedure. Hot water which drips from above is received by a water guard plate 32 so as to be led into the movable supporting portion 5.

Two nozzles 61 and 62 are mounted in an up and down configuration so as to be positioned between the droplet preventing plate 4 and the water guard plate 32. Both nozzles 61 and 62 discharge hot water supplied from a hot water supply pipe 6, and have one discharge port.

A cleaning agent is dissolved in hot water supplied via the hot water supply pipe 6, and a lot of micro air bubbles called microbubbles are mixed therewith. The hot water becomes clouded with these air bubbles. When such microbubbles are mixed with water, oil exuded by the skin which is softened by the cleaning agent is removed by the microbubbles which penetrate deeply into the pores. As a result, even if the scalp is not swiftly showered with hot water, the scalp can be ensured of receiving a good wash.

Figure 3:
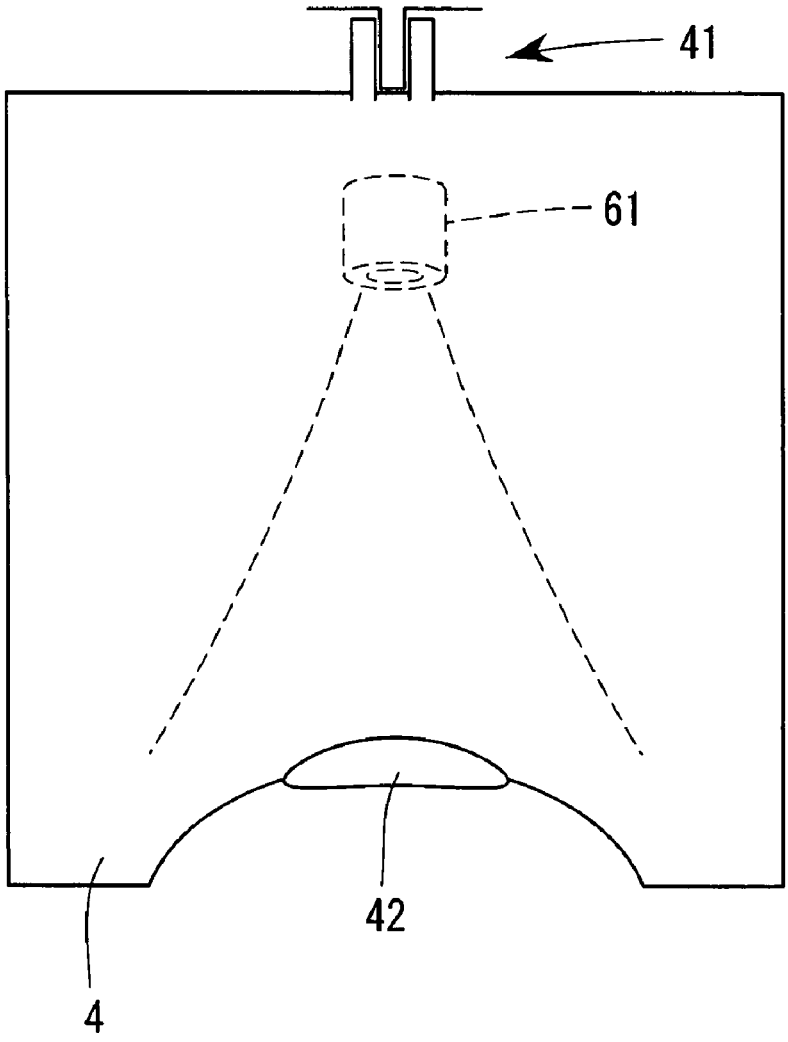
FIG. 3 is a diagram illustrating the state where hot water disperses along the droplet preventing plate of the present invention.

The angle of the upper nozzle 61 is adjusted so that the nozzle 61 discharges hot water obliquely onto the lower surface of the droplet preventing plate 4, namely, toward the surface of the user's scalp. As shown in FIG. 3, the hot water discharged from the nozzle 61 disperses to the right and left and flows in a layer along the lower surface of the droplet preventing plate 4. When the hot water reaches the edge of the droplet preventing plate 4, the hot water naturally drops off the edge of the droplet preventing plate 4 onto the user's scalp. The generation of droplets is, therefore, suppressed as much as possible.

The lower nozzle 62 is provided so as to be capable of supplying hot water intensively to the top of the head where oil exuded by the skin is particularly secreted.

Figure 2:
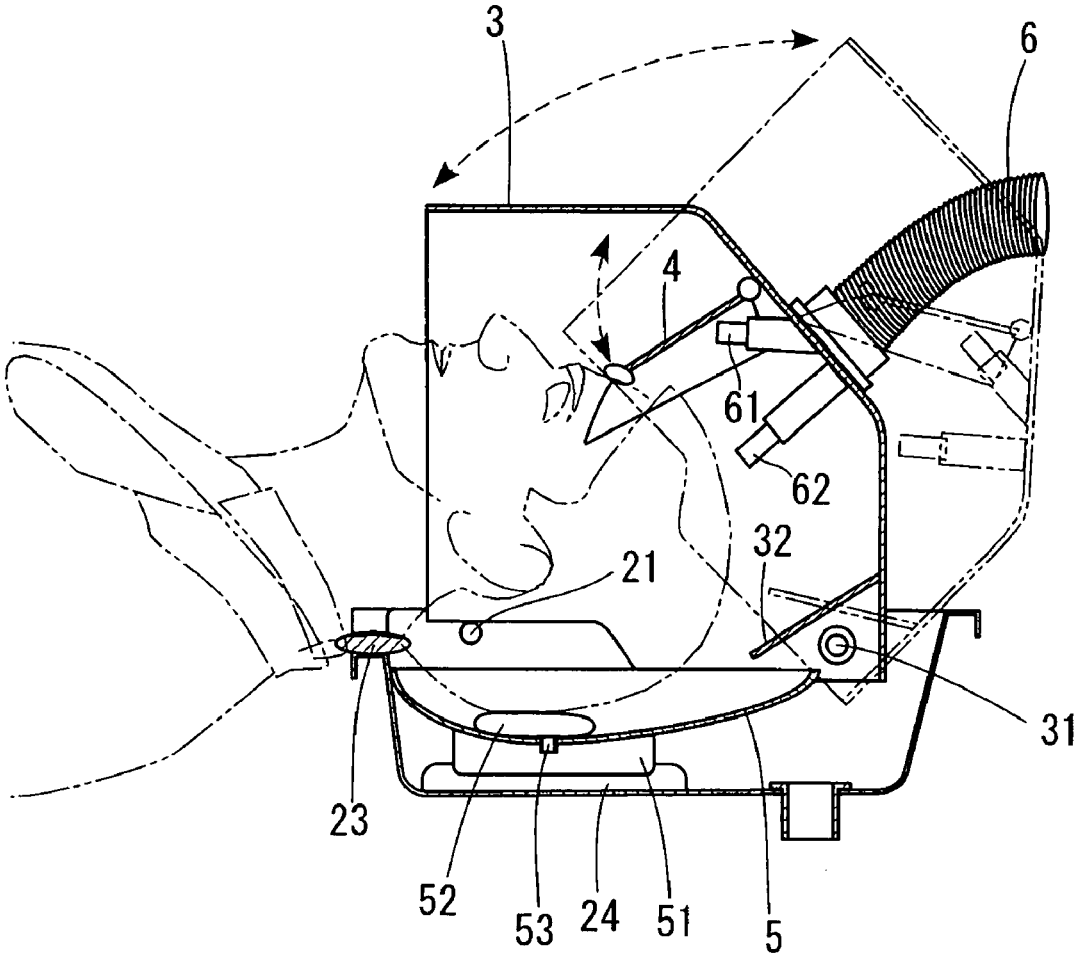
FIG. 2 is a diagram illustrating the positional relationship between a user's head and the scalp washing device of the present invention.

As shown in FIG. 2, when the cover 3 is closed, the user's face is covered with the front end of the cover 3, and a space is formed between their face and the cover 3. The space is filled with a lot of negative ions which are generated by the bursting of the microbubbles while the user's scalp is being washed. The user can inhale negative ions continuously during the washing of their scalp. When an aromatic substance having a relaxing effect is added to the hot water, the person whose scalp is being washed can inhale the aromatic substance and relax.

It should be appreciated that the present invention is not limited to the above-detailed embodiment and various modifications may be made by those skilled in the art, and such modifications may fall within the scope of the present invention.

What is claimed is:

1. A scalp washing device comprising:

a container which is positioned below a user's head, said head being positioned in an upward facing position;

a hot water jetting section which supplies hot water to the user's scalp;

a droplet preventing plate which is positioned between the user's scalp portion and face;

a cover which covers the nozzle and the droplet preventing plate;

a joint portion connecting the droplet preventing plate to the cover such that the droplet preventing plate pivots about the joint portion; and a nozzle having a single discharge port which discharges hot water to the scalp side of the droplet preventing plate, wherein the hot water discharged from the discharge port of the nozzle is dispersed along the droplet preventing plate so as to be supplied to the user's scalp.

2. The scalp washing device according to claim 1, further comprising:

a forehead pad which is provided on a portion of the droplet preventing plate to allow the droplet preventing portion to be located with respect to the user's head.

3. The scalp washing device according to claim 1, further comprising:

a support fixture which supports the user's neck on an edge of the container; and a movable supporting section provided onto the container which can adjust a gap between it and the fixing support section and supports the back of the head.

4. The scalp washing device according to claim 3, wherein the movable supporting section is formed into a bowl shape so as to be capable of storing hot water, and the back of the head is soaked in the hot water stored in the movable supporting section.

5. The scalp washing device according to claim 1, wherein the cover is extended, and covers at least a part of the user's face with a predetermined space being secured between the cover and their face.

* * * * *